US008756878B1

(12) United States Patent
Powell

(10) Patent No.: US 8,756,878 B1
(45) Date of Patent: Jun. 24, 2014

(54) SELF-ADJUSTING INSULATED SKIRTING PANEL

(71) Applicant: Timothy J. Powell, Centerville, PA (US)

(72) Inventor: Timothy J. Powell, Centerville, PA (US)

( * ) Notice: Subject to any disclaimer, the term of this patent is extended or adjusted under 35 U.S.C. 154(b) by 0 days.

(21) Appl. No.: 13/751,223

(22) Filed: Jan. 28, 2013

(51) Int. Cl.
*E04C 2/30* (2006.01)
*E02D 31/00* (2006.01)

(52) U.S. Cl.
USPC ..... 52/169.12; 52/DIG. 3; 280/768

(58) Field of Classification Search
CPC ..... Y10S 52/03
USPC ..... 52/169.12, 406.2, DIG. 3, 126.3, 406.3; 280/768; 160/216, 222, 226, 227; 428/71
See application file for complete search history.

(56) References Cited

U.S. PATENT DOCUMENTS 2,118,271 A * 5/1938 Slayter ..... 454/214
3,113,357 A 12/1963 Reukauf et al.
3,218,091 A * 11/1965 Doak ..... 280/768
3,383,819 A 5/1968 Zimmer et al.
3,562,983 A * 2/1971 Rector ..... 52/169.12
3,589,085 A 6/1971 Sickler
3,694,979 A * 10/1972 Vadnie ..... 52/169.12
3,710,525 A * 1/1973 Lopes ..... 52/169.12
3,722,156 A * 3/1973 Bryant ..... 52/169.12
3,753,323 A * 8/1973 Nesbitt ..... 52/169.12
3,785,675 A 1/1974 Norris et al.
4,107,888 A * 8/1978 Krueger ..... 52/169.12
5,475,955 A * 12/1995 Dickinson ..... 52/202

* cited by examiner

*Primary Examiner* — Robert Canfield
(74) *Attorney, Agent, or Firm* — Robert C. Montgomery; Montgomery Patent & Design

(57) ABSTRACT

A self-adjusting trailer skirting system provides an insulated and aesthetic appearance to an elevated structure and includes a series of modular panels, each of which having a bottom section slideably connected within an upper panel. An interior of each panel can be filled with foam insulation. The outer edge of each panel can include a flange such that each panel can be interlocked to adjacent panels. Each panel system can also include an interior spring to keep the panel sections forced apart and against grade. The upper portion is fastened into place while the spring forces the lower portion of the panel against the nearby grade.

19 Claims, 3 Drawing Sheets

SELF-ADJUSTING INSULATED SKIRTING PANEL

RELATED APPLICATIONS

Not applicable.

FIELD OF THE INVENTION

The present invention relates generally to skirting for open structures, and in particular, to a self-adjusting insulated skirting panel system.

BACKGROUND OF THE INVENTION

With the recent hike in energy costs, many are reexamining their home energy usage in an effort to save on the family budget. For many homes, the heating and cooling bill is one (1) of the largest components of the household budget. These same budget worries affect those living in mobile homes. Many people resort to the use of skirting placed around the bottom perimeter of the mobile home in order to eliminate heat loss or heat gain. These skirting systems are often custom applied and may utilize conventional insulation to further the heat insulation properties of the skirting.

Unfortunately, mobile homes are often prone to settling over time causing buckling or gaps within the skirting system, which results in an un-aesthetically pleasing appearance. It requires almost constant readjustment and realignment and often results in gaps or damage to the insulation surface.

Accordingly, there exists a need for trailer skirting that addresses the concerns as described above.

SUMMARY OF THE INVENTION

The inventor has recognized the aforementioned inherent problems and lack in the art and observed that there is a need for a skirting system that can easily adjusted, is aesthetically pleasing and provides for increased insulation. The development of the present invention, which will be described in greater detail herein, substantially departs from conventional solutions to provide a self-adjusting insulated skirting panel and in doing so fulfills this need.

In one (1) embodiment, the disclosed skirting panel can include an upper panel having an exterior surface, a laterally spaced apart interior surface, and an interstitial space disposed between the exterior surface and the interior surface; a lower panel slidably connected to the upper panel, the lower panel having an exterior surface, a laterally spaced apart interior surface, and an interstitial space disposed between the exterior surface and the interior surface; an upper insulating panel disposed within the upper panel interstitial space extending longitudinally from an upper end to proximate a lower end of the upper panel; and, a lower insulated panel disposed within the lower panel interstitial space extending longitudinally from proximate an upper end to a lower end of the lower panel; wherein the lower panel moves longitudinally relative to the upper panel.

In another embodiment, the disclosed skirting panel system can include a plurality of interconnecting skirting panels, each skirting panel can include an upper panel having an exterior surface, a laterally spaced apart interior surface, and an interstitial space disposed between the exterior surface and the interior surface; a lower panel slidably connected to the upper panel, the lower panel having an exterior surface, a laterally spaced apart interior surface, and an interstitial space disposed between the exterior surface and the interior surface; an upper insulating panel disposed within the upper panel interstitial space extending longitudinally from an upper end to proximate a lower end of the upper panel; a lower insulated panel disposed within the lower panel interstitial space extending longitudinally from proximate an upper end to a lower end of the lower panel; wherein the lower panel and the upper panel move longitudinally relative to one another.

Furthermore, the described features and advantages of the disclosed self-adjusting insulated skirting panel can be combined in various manners and embodiments as one skilled in the relevant art will recognize after reading the present disclosure. The disclosure can be practiced without one (1) or more of the features and advantages described in any particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
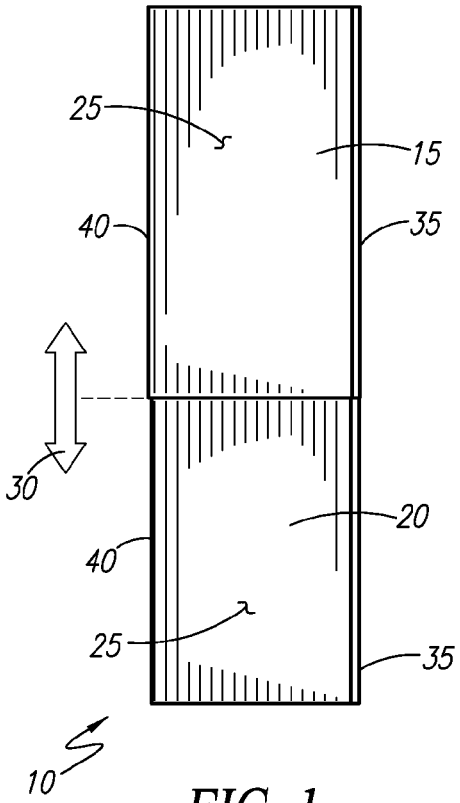
FIG. 1 is a front view of a self-adjusting insulated skirting panel in accordance with the present invention.

10 self-adjusting insulated skirting panel
15 upper panel
20 lower panel
25 exterior surface
30 first travel path arrow
35 connection tongue
40 connection groove
45 interstitial space
50 interior surface
55 insulating panel
60 spring mechanism
65 elevated structure
70 lower bearing surface
75 mounting surface
80 surrounding grade
85 ground mounting plate
90 securing spikes
95 "C"-shaped channel
100 fasteners
105 second travel path arrow

DETAILED DESCRIPTION OF THE PREFERRED EMBODIMENT

In accordance with the invention, the best mode is presented in terms of the described embodiments, herein depicted within FIGS. 1 through 5. However, the disclosure is not limited to the described embodiments and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only certain configurations have been shown and described for purposes of clarity and disclosure and not by way of limitation of scope.

It can be appreciated that, although such terms as first, second, etc. may be used herein to describe various elements, these elements should not be limited by these terms. These terms are only used to distinguish one (1) element from another element. Thus, a first element discussed below could be termed a second element without departing from the scope of the present invention. In addition, as used herein, the singular forms "a", "an" and "the" are intended to include the plural forms as well, unless the context clearly indicates otherwise. It also will be understood that, as used herein, the term "comprising" or "comprises" is open-ended, and includes one or more stated elements, steps or functions without precluding one (1) or more unstated elements, steps or functions. Relative terms such as "front" or "rear" or "left" or "right" or "top" or "bottom" or "below" or "above" or "upper" or "lower" or "horizontal" or "vertical" may be used herein to describe a relationship of one (1) element, feature or region to another element, feature or region as illustrated in the figures. It should be understood that these terms are intended to encompass different orientations of the device in addition to the orientation depicted in the figures. It should also be understood that when an element is referred to as being "connected" to another element, it can be directly connected to the other element or intervening elements may be present. In contrast, when an element is referred to as being "directly connected" to another element, there are no intervening elements present. It should also be understood that the sizes and relative orientations of the illustrated elements are not shown to scale, and in some instances they have been exaggerated for purposes of explanation.

Referring now to FIGS. 1 through 5, disclosing a self-adjusting insulated skirting panel (herein generally described as a "panel") 10, where like reference numerals represent similar or like parts. In accordance with the present disclosure, the panel 10 is intended for use when skirting a lower opening of a mobile structure, such as a mobile home, recreational vehicle or the like. However, it can be appreciated by those skilled in the art that the panel 10 may be used for other purposes, such as elevated decks, permanent homes, crawl-space openings and the like, and as such, should not be interpreted as a limiting factor of the present disclosure.

Referring now to FIG. 1, the panel 10 can include an upper panel 15 and a lower panel 20. The overall dimensions of the panel 10 can be approximately twelve inches (12 in.) wide and five feet (5 ft.) tall with the upper panel 15 and the lower panel 20 each being approximately two-and-a-half feet (2½ ft.) tall. It should be noted that the panel 10 is capable of being trimmed to the exact size needed in the field using common tools such as saws, knives, and the like. Additionally, the teachings of the panel 10 can be adapted to panels of other sizes, both larger and smaller, and as such, the aforementioned dimensions should not be interpreted as a limiting factor of the present disclosure. It is envisioned that the upper panel 15 and the lower panel 20 can be manufactured of a layered or "sandwich" design with an exterior surface 25 made of a durable material such as polyvinyl chloride. Such a material can withstand extreme environmental elements such as extreme temperatures, wetness, and the rays of the sun. However, other materials such as aluminum, steel, fiberglass and the like, can also be considered, and as such, should not be interpreted as a limiting factor of the present disclosure.

The lower panel 20 can be of a slightly smaller width and depth when compared to the upper panel 15, and as such allows for travel in and out of the upper panel 15 as depicted by a first travel path arrow 30. Further description of the motion afforded by the first travel path arrow 30 will be provided herein below. Also visible in FIG. 1 is a connection tongue 35, which connects to a connection groove 40 (only partially visible in FIG. 1) on adjacent panels to provide for the inherent stability of multiple panels 10 connected in a linear format.

Figure 2:
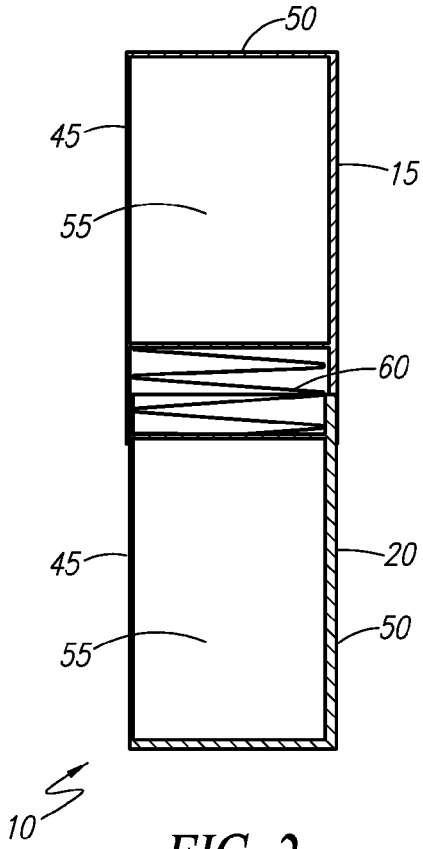
FIG. 2 is a cross-sectional view of the self-adjusting insulated skirting panel.

Referring next to FIG. 2, this figure shows the interlocking and overlapping nature of the upper panel 15 in relation to the lower panel 20. The overall depth of the panel 10 is approximately one-and-a-half inches (1½ in.) thick. An interstitial space 45 is formed between the exterior surface 25 (as shown in FIG. 1) and an interior surface 50 (only partially shown in this FIG. due to illustrative limitations) in both the upper panel 15 and the lower panel 20. The interstitial space 45 can be filled with an insulating panel 55 in both the upper panel 15 and the lower panel 20.

The insulating panel 55 can be made of STYROFOAM™ or similar material to provide thermal insulating properties. The use of the exterior surface 25, the insulating panel 55, and then the interior surface 50 can provide the layered or "sandwich" construction as aforementioned described. The lower section of the upper panel 15 as well as the upper section of the lower panel 20 is void of the insulating panel 55.

The void can be filled with a spring mechanism 60. This spring mechanism 60 can self-adjust from a minimum height of approximately one inch (1 in.) to a maximum of nine inches (9 in.). During initial installation of the panel 10, the spring mechanism 60 can be placed at approximately four inches (4 in.) of compression. Thus as expansion, contraction, settling, upheaval, and other forces happen over time, the panel 10 will maintain a constant aesthetically pleasing appearance due to the self-adjusting nature of the spring mechanism 60 and can accommodate movement depicted by the first travel path arrow 30 (FIG. 1) of up to approximately four inches (+/−4 in.).

Figure 3:
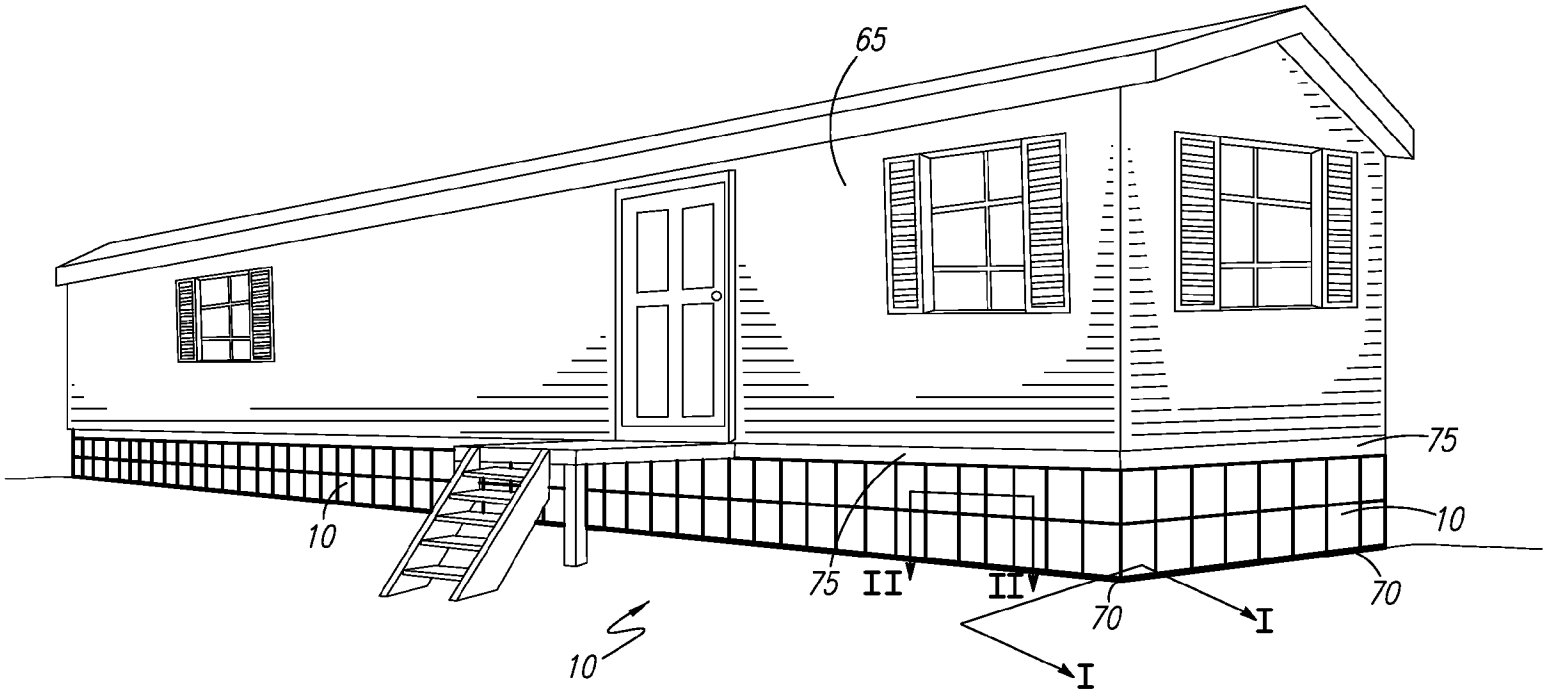
FIG. 3 is a pictorial diagram of the self-adjusting insulated skirting panel 10 depicted in an installed state upon an elevated structure.

Referring now to FIG. 3, multiple panels 10 can be installed in an interlocking manner between a lower bearing surface 70 and a mounting surface 75 as provided on the elevated structure 65. The field customizable nature of the panel 10 allows for easy adaptation of the exterior height and width dimensions as necessary to fit any and all specific installation. Varying heights of surrounding grade 80 can be easily accommodated during initial installation of the panel 10 and allows for self-regulation as well as when the surrounding grade 80 moves up or down in relation to the elevated structure 65. It is envisioned that the panel 10 can be installed during initial construction or placement of the elevated structure 65 or can take place years later during remodeling or refurbishment projects.

Figure 4:
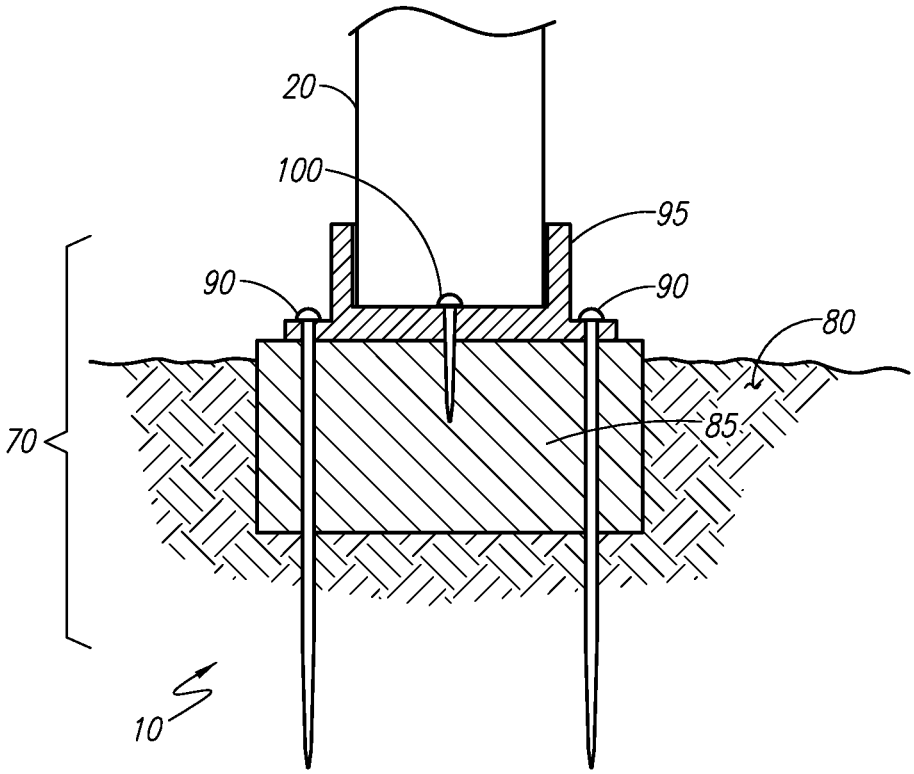
FIG. 4 is a sectional view of the self-adjusting insulated skirting panel taken along section line I-I of FIG. 3; and, FIG. 5 is a sectional view of the self-adjusting insulated skirting panel taken along section line II-II of FIG. 3.

Referring next to FIG. 4, a sectional view of the panel 10 as shown along a line I-I of FIG. 3. This view depicts the construction of the lower bearing surface 70. A ground mounting plate 85 is placed into the surrounding grade 80 in flush or nearly flush position. It is envisioned that the ground mounting plate 85 can be made of pressure treated lumber or similar material that can withstand wetness, rot, insects and other hazards present in such an environment. The ground mounting plate 85 can be held in place by securing spikes 90 which are driven through the ground mounting plate 85 and into the surrounding grade 80 in a standard sequence spacing arrangement.

A "C"-shaped channel 95 having integrated drain holes can be mounted to the ground mounting plate 85 in an inverted basis. It can be secured in place using fasteners 100, such as nails or screws. The mounting feature afforded by the lower bearing surface 70 allows for the insertion of the lower panel 20 where it is maintained in place due the spring nature of the spring mechanism 60 (FIG. 2). A similar mounting arrangement can be provided on the mounting surface 75 (FIG. 3) or can be directly fastened to the mounting surface 75 (FIG. 3) to suit specific installation requirements.

Figure 5:
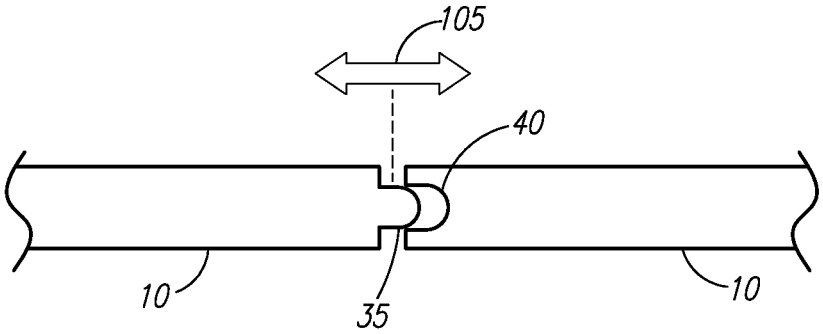

Referring to FIG. 5, a sectional view of the panel 10 as shown along a line II-II of FIG. 3. This figure shows the junction between two (2) adjacent panels 10. One (1) edge of one (1) panel 10 can include a connection tongue 35 while the opposite side of another panel 10 can include the connection groove 40. The connection tongue 35 and the connection groove 40 can be placed in contact with one another and remain so by a physical friction fit method. Minor movement, as depicted by a second travel path arrow 105, allows for minor movement of the multiple panels 10 to account for thermal expansion, settling, measurement error and the like. In any event, the union formed by the connection tongue 35 and the connection groove 40 can eliminate pass through gaps between adjacent panel 10 thus ensuring aesthetic visual appeal as well as a junction which will enhance the thermal capabilities of the panel 10 as well as prohibit animals from passing through.

It is envisioned that other styles and configurations of the present panel 10 can be easily incorporated into the teachings of the present disclosure, and only particular configurations have be shown and described for purposes of clarity and disclosure and not by way of limitation of scope.

The present panel can be installed and utilized by the common user in a simple and effortless manner with little or no training. After initial purchase or acquisition of the panel 10, it can be installed as indicated in FIG. 3.

Installation of the panel 10 can begin by placement of the ground mounting plate 85 in a vertically plumb position beneath the mounting surface 75 of an elevated structure 65. It can then be fastened into place by periodic placement and driving of securing spikes 90 into the surrounding grade 80. Next, the "C"-shaped channel 95 can be placed along the centerline of the ground mounting plate 85 and secured with the fasteners 100 as necessary. A similar installation in an inverted manner can occur on the mounting surface 75, if required. The installer can then measure the distance between the "C"-shaped channel 95 and the respective upper mounting surface as provided by the mounting surface 75. This distance can then be used to cut the panel 10 to the necessary size. However, the panel 10 would then be first compressed approximately four (4) inches and half of the measured distance would be cut from the distal end of the upper panel 15 and the other half would be cut from the distal end of the lower panel 20. This equal cutting arrangement would maintain a matching centerline junction of the panel 10 resulting in increased visual appeal. At this point in time, the panel 10 is ready to be placed into final position.

The user can then compress the upper panel 15 and the lower panel 20 together and place them within the "C"-shaped channel 95, as required. Upon release, the panel 10 will expand as necessary to fill the void. This same process is repeated with the adjacent panel 10, with the added step of sliding the newly placed panel 10 up against the previously placed panel 10 and engaging the connection tongue 35 and connection groove 40 as shown in FIG. 5. This process then continues in a cyclical manner until the entire area under the elevated structure 65 is enclosed and protected. Such placement provides increase visual appeal, physical protection against animals, and an increased thermal barrier for the elevated structure 65 resulting in lower heating and cooling costs.

The foregoing embodiments of the disclosed self-adjusting insulated skirting panel have been presented for purposes of illustration and description. They are not intended to be exhaustive or to limit the invention and method of use to the precise forms disclosed. It can be appreciated by one skilled in the art that other styles, configurations, and modifications of the invention can be incorporated into the teachings of the present disclosure upon reading the specification and that the embodiments of the assembly shown and described are for the purposes of clarity and disclosure and to limit the scope. The embodiments have been chosen and described in order to best explain the principles and practical application in accordance with the invention to enable those skilled in the art to best utilize the various embodiments with expected modifications as are suited to the particular use contemplated. The present application includes such modifications and is limited only by the scope of the claims.

What is claimed is:

1. A skirting panel comprising:

an upper panel comprising an exterior surface, a laterally spaced apart interior surface, and an interstitial space disposed between said exterior surface and said interior surface;

a lower panel slidably connected to said upper panel, said lower panel comprising an exterior surface, a laterally spaced apart interior surface, and an interstitial space disposed between said exterior surface and said interior surface;

an upper insulating panel disposed within said upper panel interstitial space extending longitudinally from an upper end to proximate a lower end of said upper panel;

a lower insulated panel disposed within said lower panel interstitial space extending longitudinally from proximate an upper end to a lower end of said lower panel; and, a spring mechanism disposed within said upper panel interstitial space of said upper panel lower end and said lower panel interstitial space of said lower panel upper end to bias said lower panel and said upper panel away from one another;

wherein said lower panel moves longitudinally relative to said upper panel.

2. The skirting panel of claim 1, wherein said exterior surface of said upper panel and said lower panel is made of polyvinyl chloride.

3. The skirting panel of claim 2, wherein said interior surface of said upper panel and said lower panel is made of polyvinyl chloride.

4. The skirting panel of claim 1, wherein said upper panel exterior surface, said upper insulating panel, and said upper panel interior surface comprise a sandwiched configuration.

5. The skirting panel of claim 1, wherein said lower panel exterior surface, said lower insulating panel, and said lower panel interior surface comprise a sandwiched configuration.

6. The skirting panel of claim 1, wherein said spring mechanism comprises a coiled compression spring having an upper end in contact with said upper insulation panel and a lower end in contact with said lower insulation panel.

7. The skirting panel of claim 1, wherein said upper end of said lower panel is configured to be slidably received within said lower end of said upper panel.

8. The skirting panel of claim 1, wherein said lower end of said upper panel is configured to be slidably received within said upper end of said lower panel.

9. The skirting panel of claim 1, wherein said upper panel further comprises an outwardly protruding tongue extending longitudinally along a side surface and an inwardly recessed groove extending longitudinally along an opposing side surface.

10. The skirting panel of claim 1, wherein said lower panel further comprises an outwardly protruding tongue extending longitudinally along a side surface and an inwardly recessed groove extending longitudinally along an opposing side surface.

11. The skirting panel of claim 1, further comprising:

a ground mounting plate configured to anchored to a graded surface; and, a C-shaped channel attached to said ground mounting plate, said C-shaped channel being configured to receive said lower end of said lower panel.

12. A skirting panel system comprising a plurality of interconnecting skirting panels, each skirting panel comprising:

an upper panel comprising an exterior surface, a laterally spaced apart interior surface, and an interstitial space disposed between said exterior surface and said interior surface;

a lower panel slidably connected to said upper panel, said lower panel comprising an exterior surface, a laterally spaced apart interior surface, and an interstitial space disposed between said exterior surface and said interior surface;

an upper insulating panel disposed within said upper panel interstitial space extending longitudinally from an upper end to proximate a lower end of said upper panel; and, a lower insulated panel disposed within said lower panel interstitial space extending longitudinally from proximate an upper end to a lower end of said lower panel;

wherein said lower panel and said upper panel move longitudinally relative to one another.

13. The skirting panel system of claim 12, wherein each skirting panel further comprising a spring mechanism disposed within said upper panel interstitial space of said upper panel lower end and said lower panel interstitial space of said lower panel upper end to bias said lower panel and said upper panel away from one another.

14. The skirting panel system of claim 13, wherein each said upper panel further comprises an outwardly protruding tongue extending longitudinally along a side surface and an inwardly recessed groove extending longitudinally along an opposing side surface;

wherein said tongue of a one upper panel matingly engages said groove of another upper panel to attach adjacent upper panels.

15. The skirting panel of claim 13, wherein each said lower panel further comprises an outwardly protruding tongue extending longitudinally along a side surface and an inwardly recessed groove extending longitudinally along an opposing side surface;

wherein said tongue of a one lower panel matingly engages said groove of another lower panel to attach adjacent skirting panels.

16. The skirting panel system of claim 13, wherein each said skirting panel further comprises an outwardly protruding tongue extending longitudinally along a side surface and an inwardly recessed groove extending longitudinally along an opposing side surface;

wherein said tongue of a one skirting panel matingly engages said groove of another skirting panel to attach adjacent skirting panels.

17. The skirting panel system of claim 16, wherein said upper end of said lower panel is configured to be slidably received within said lower end of said upper panel.

18. The skirting panel system of claim 16, wherein said lower end of said upper panel is configured to be slidably received within said upper end of said lower panel.

19. The skirting panel system of claim 16, further comprising:

a plurality of ground mounting plates, each ground mounting plates being configured to anchored to a graded surface; and a plurality of C-shaped channels, each C-shaped channel attached to one of said ground mounting plates;

wherein each said C-shaped channel is configured to receive said lower end of said lower panel.

* * * * *